US007963576B2

(12) United States Patent
Bigazzi et al.

(10) Patent No.: US 7,963,576 B2
(45) **Date of Patent: *Jun. 21, 2011**

(54) AUTOMOTIVE DOOR LOCK

(75) Inventors: Luca Bigazzi, Ponsacco (IT); Corrado Taviani, Fucecchio (IT)

(73) Assignee: Intier Automotive Closures S.p.A., Cascine Vica Rivoli (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/228,303

(22) Filed: Aug. 12, 2008

(65) Prior Publication Data

US 2009/0007607 A1 Jan. 8, 2009

Related U.S. Application Data

(63) Continuation of application No. 11/453,687, filed on Jun. 15, 2006, now Pat. No. 7,475,920.

(60) Provisional application No. 60/690,783, filed on Jun. 15, 2005.

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23

See application file for complete search history.

(56) References Cited

U.S. PATENT DOCUMENTS

| | | | |
|---|---|---|---|
| 5,516,164 | A | 5/1996 | Kobayashi |
| 6,305,727 | B1 | 10/2001 | Bland |
| 6,386,600 | B1 | 5/2002 | Kaisi |
| 6,390,516 | B1 | 5/2002 | Kobayashi |
| 6,428,058 | B1 | 8/2002 | Gruate |
| 6,428,059 | B2 | 8/2002 | Kobayashi et al. |
| 6,540,272 | B2 | 4/2003 | Spurr |
| 6,733,052 | B2 | 5/2004 | Perkins et al. |
| 6,749,234 | B2 | 6/2004 | Bruce |
| 6,866,311 | B2 | 3/2005 | Spurr et al. |
| 6,948,745 | B2 | 9/2005 | Chevalier |
| 6,997,488 | B2 | 2/2006 | Kurten et al. |
| 7,000,956 | B2 | 2/2006 | Fisher |
| 7,261,335 | B2 * | 8/2007 | Schupp ..... 292/201 |

(Continued)

FOREIGN PATENT DOCUMENTS

DE 19650826 6/1998

(Continued)

OTHER PUBLICATIONS

English Abstract of DE 10344244 Dated Apr. 1, 2004.

(Continued)

*Primary Examiner* — Carlos Lugo
*Assistant Examiner* — Mark Williams
(74) *Attorney, Agent, or Firm* — Miller Canfield

(57) ABSTRACT

An automotive door lock having a lock mechanism (3) for releasably engaging a striker (4), and a release mechanism (5) interacting with the lock mechanism (3) to release the lock (1). The release mechanism (5) has a control member (18) which interacts with the lock mechanism (3), is loaded elastically into a rest position, and can be set to a work position to release the lock (1). The release mechanism (5) has an actuating member (31) activated selectively to move the control member (18), in a forward movement, from the rest position to the work position; and, during a return movement of the control member (18) to the rest position, the control member (18) and the actuating member (31) are disconnected to minimize the time taken to complete the return movement.

7 Claims, 5 Drawing Sheets

U.S. PATENT DOCUMENTS

| | | | | |
|---|---|---|---|---|
| 7,475,920 | B2 * | 1/2009 | Bigazzi et al. | 292/201 |
| 2006/0012185 | A1 | 1/2006 | Kiehl | |

FOREIGN PATENT DOCUMENTS

| | | |
|---|---|---|
| DE | 10344244 | 4/2004 |
| EP | 1188890 | 3/2002 |
| FR | 2762639 | 10/1998 |

OTHER PUBLICATIONS

English Abstract of FR 2762639 Dated Oct. 30, 1998.
English Abstract of DE 19650826 Dated Jun. 10, 1998.
English Abstract of EP 1188890 Dated Mar. 20, 2002.
EPO Search Report Dated Feb. 26, 2008 for EP 06010276.1.

* cited by examiner

AUTOMOTIVE DOOR LOCK

CROSS REFERENCE TO RELATED APPLICATIONS

This application is a continuation of U.S. application Ser. No. 11/453,687 now U.S. Pat. No. 7,475,920, filed Jun. 15, 2006, which claims priority to and all the benefits of U.S. Provisional Application No. 60/690,783, filed Jun. 15, 2005.

FIELD OF THE INVENTION

The present invention relates to an automotive door lock. More particularly, the invention relates to a door lock comprising a lock mechanism for releasably engaging a striker and a release mechanism interacting with the lock mechanism to release the lock.

DESCRIPTION OF THE RELATED ART

As is known, automotive locks substantially comprise a supporting body fixed to a door of the vehicle; and a lock mechanism carried by the supporting body and which engages a striker integral with a door post. Solutions are also known in which the lock is fixed to the door post, and the striker is integral with the door.

Known locks also comprise a release mechanism activated selectively to disconnect the striker from the lock mechanism. More specifically, known release mechanisms substantially comprise a movable control lever which interacts with the lock mechanism; and an actuating member activated selectively by a motor to move the control lever. More specifically, the control lever is loaded by a spring into a rest position, in which it is detached from the lock mechanism, thus permitting connection of the lock mechanism to the striker. Under control of the actuating member, the control lever performs a forward movement, in opposition to the spring, from the rest position to a work position, in which it releases the lock mechanism from the striker. Once the forward movement is completed, the motor is deactivated, and the spring causes the control lever to perform a return movement to the rest position, taking the actuating member with it.

The striker and lock mechanism are engaged by slamming the door against the door post. If the door is slammed against the post shortly after the release mechanism is operated, the lock mechanism is prevented from engaging the striker on account of the actuating member and control lever still performing the return movement so that the control lever is not set to the rest position. As such, the lock cannot be engaged until the control lever is restored fully to the rest position.

SUMMARY OF THE INVENTION

It is an object of the present invention to provide an automotive door lock designed to provide a straightforward, low-cost solution to the aforementioned drawback typically associated with known locks. According to one aspect of the invention, there is provided an automotive door lock comprising a lock mechanism for releasably engaging a striker and a release mechanism interacting with the lock mechanism to release the lock. The release mechanism comprises a control member which interacts with the lock mechanism, is loaded elastically into a rest position, and can be set to a work position to release the lock. The release mechanism further includes an actuating member activated selectively to move the control member in a forward movement from the rest position to the work position. During a return movement of the control member to the rest position, the control member and the actuating member are disconnected to minimize the time taken to complete the return movement.

BRIEF DESCRIPTION OF THE DRAWINGS

Advantages of the present invention will be readily appreciated as the same becomes better understood in reference to the following detailed description when considered in connection with the accompanying drawings, wherein.

DETAILED DESCRIPTION OF THE PREFERRED EMBODIMENT

Figure 2:
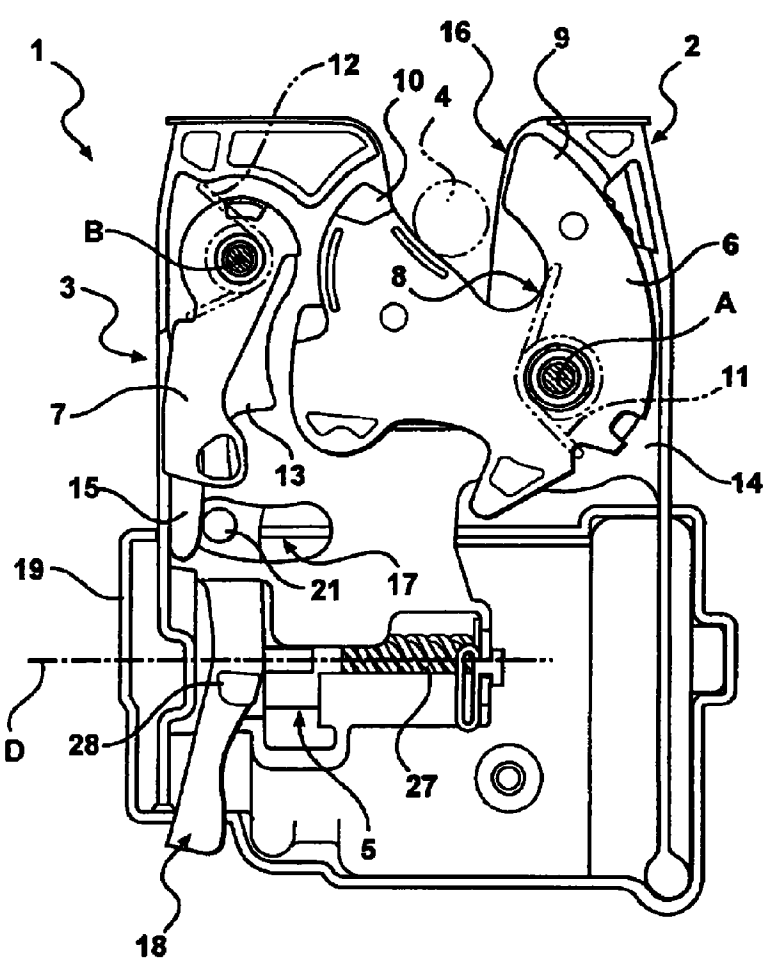
FIG. 2 is a top plan view of the automotive door look in a release position.

With reference to FIGS. 1 to 4, number 1 indicates, as a whole, an automotive door lock, e.g., a hatch lock, substantially comprising a supporting body 2 (shown partly) fixed to the vehicle door; a lock mechanism 3 connected to supporting body 2 and which releasably engages a striker 4 fitted to a door post (not shown); and a release mechanism 5 connected to supporting body 2 and for releasing striker 4 from lock mechanism 3.

More specifically, supporting body 2 substantially comprises a plate 14, to which lock mechanism 3 and release mechanism 5 are fixed on opposite sides. Plate 14 comprises a seat 16 enabling striker 4 to engage and interact with lock mechanism 3; and a slot 17 enabling interaction between lock mechanism 3 and release mechanism 5. Supporting body 2 also comprises a shell 19 fixed to plate 14 and housing release mechanism 5 as described in detail below.

Lock mechanism 3 comprises a fork 6 and a pawl 7 hinged to plate 14 about respective axes A and B parallel to each other and perpendicular to plate 14. More specifically, fork 6 comprises a peripheral seat 8 bounded by two teeth 9, 10 and for receiving striker 4, and is loaded by a spring 11, interposed between plate 14 and fork 6, into a release position (FIGS. 2 and 4), in which seat 8 faces in an insertion/withdrawal direction of striker 4.

When the door is slammed, fork 6 is rotated by striker 4—about axis A, in opposition to spring 11, and in a click-on movement in which it engages pawl 7—into a lock position (FIGS. 1 and 3), in which striker 4 is locked inside seat 8, and tooth 9 prevents withdrawal of striker 4 in known manner. More specifically, and with particular reference to FIGS. 1 and 2, pawl 7 is loaded by a spring 12, fixed to plate 14 and to pawl 7, towards a peripheral edge of fork 6, and comprises an L-shaped end edge defining a catch portion 13, which clicks onto tooth 10 to releasably lock fork 6 in the lock position. At its free end opposite axis B, pawl 7 comprises an interacting portion 15 housed inside slot 17 and movable along slot 17 by release mechanism 5.

Figure 1:
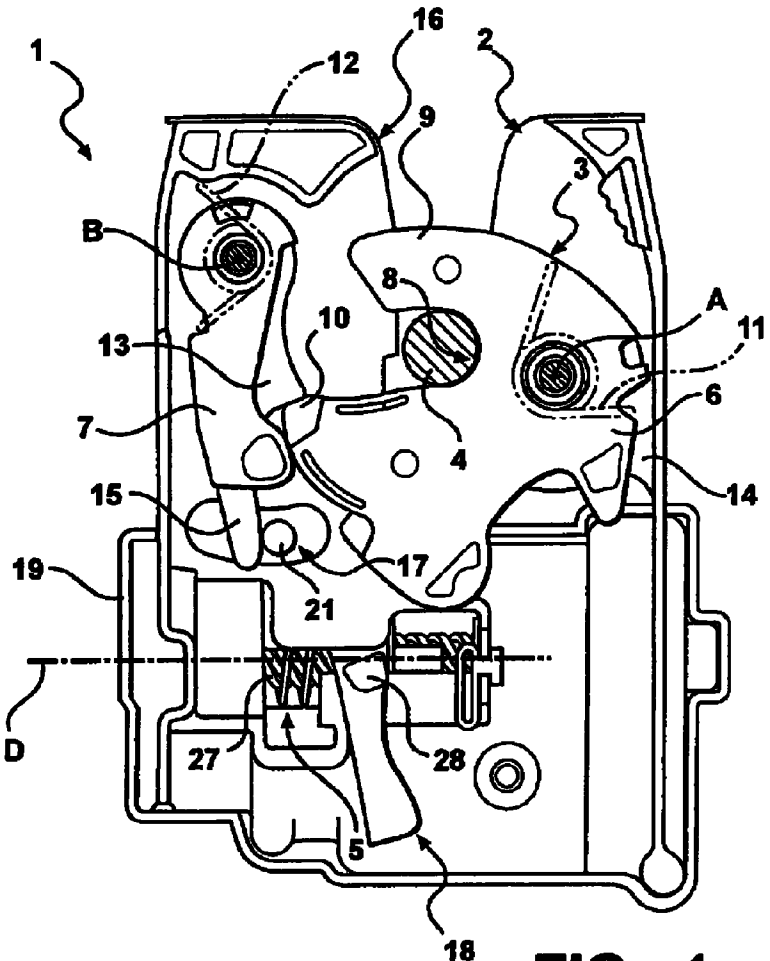
FIG. 1 is a top plan view of an automotive door lock in a lock position.
Figure 3:
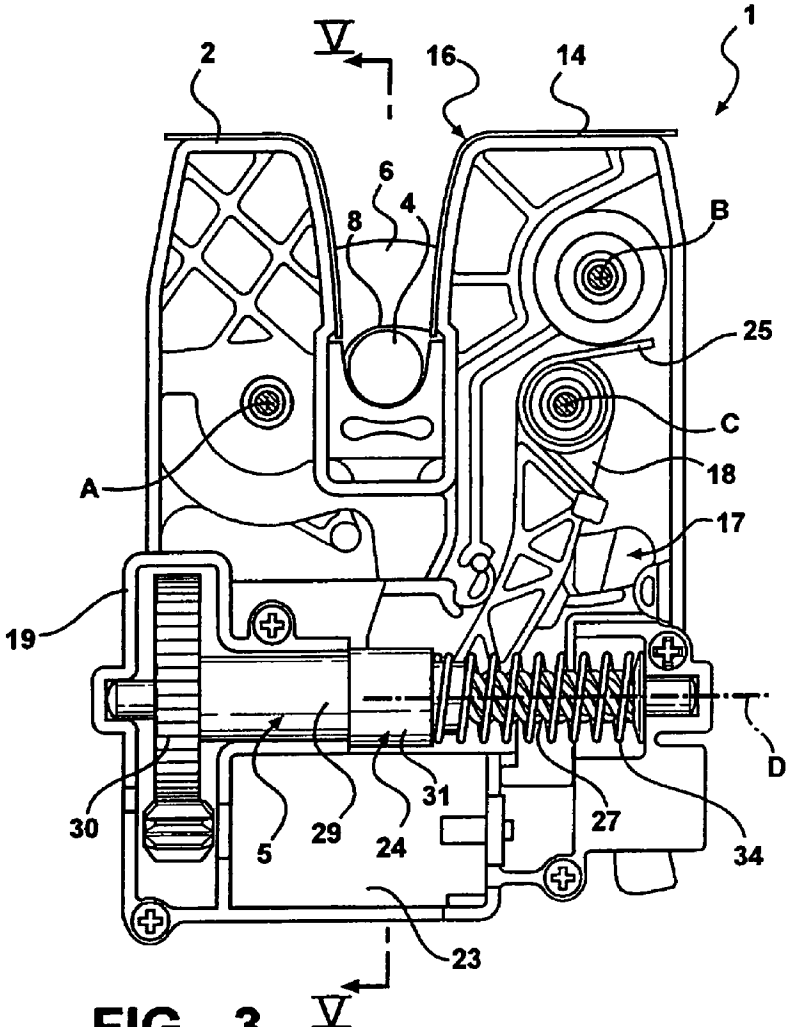
FIG. 3 is a bottom plan view of the lock in the lock position.
Figure 5:
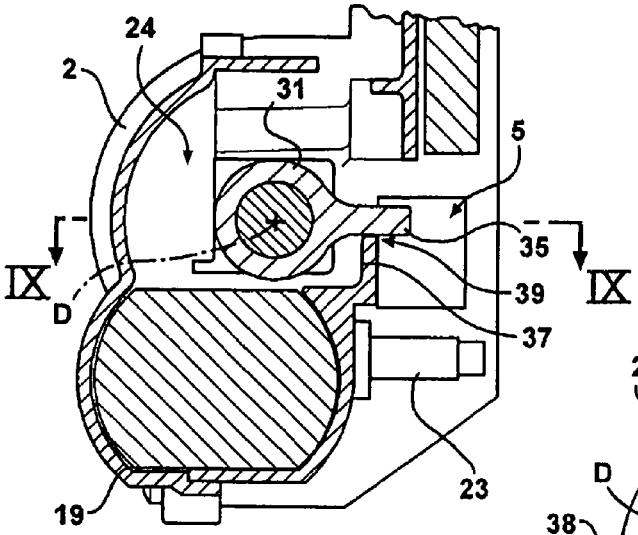
FIG. 5 is a cross-sectional view taken along line V-V in FIG. 3.
Figure 6:
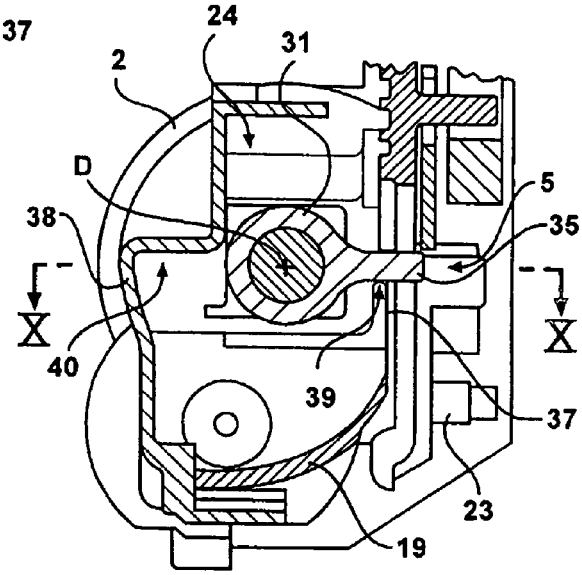
FIG. 6 is a cross-sectional view taken along line VI-VI in FIG. 4.

When release mechanism 5 acts on interacting portion 15, pawl 7 is moved—about axis B, in opposition to spring 12, and in a fork 6 release movement—into a position in which catch portion 13 and tooth 10 are disconnected, and fork 6 can be restored by spring 11 to the release position (FIGS. 1 and 3).

With reference to FIGS. 3-4 and 9-12, release mechanism 5 comprises a control lever 18 having an intermediate actuating projection 21 housed, in use, inside slot 17 and for pushing interacting portion 15 to move pawl 7 in opposition to spring 12; a motor 23 operated selectively to move an end portion 28 of control lever 18 so that actuating projection 21 exerts thrust on interacting portion 15; and a transmission assembly 24 for functionally connecting motor 23 and control lever 18 as described in detail below.

More specifically, motor 23 and transmission assembly 24 are housed inside shell 19; the end of control lever 18 opposite end portion 28 is hinged to plate 14 about an axis C parallel to axes A and B; and end portion 28 is housed inside shell 19. A spring 25, fixed to plate 14 and to control lever 18, loads control lever 18 into a rest position, in which actuating projection 21 exerts no thrust on interacting portion 15 of pawl 7. When end portion 28 is moved, control lever 18 is moved into a work position, in which actuating projection 21 exerts thrust on interacting portion 15 of pawl 7 to release pawl 7 from fork 6. When actuating projection 21 ceases to exert thrust on interacting portion 15, spring 25 restores control lever 18, in a return movement in the opposite direction to the forward movement, to the rest position.

Figure 4:
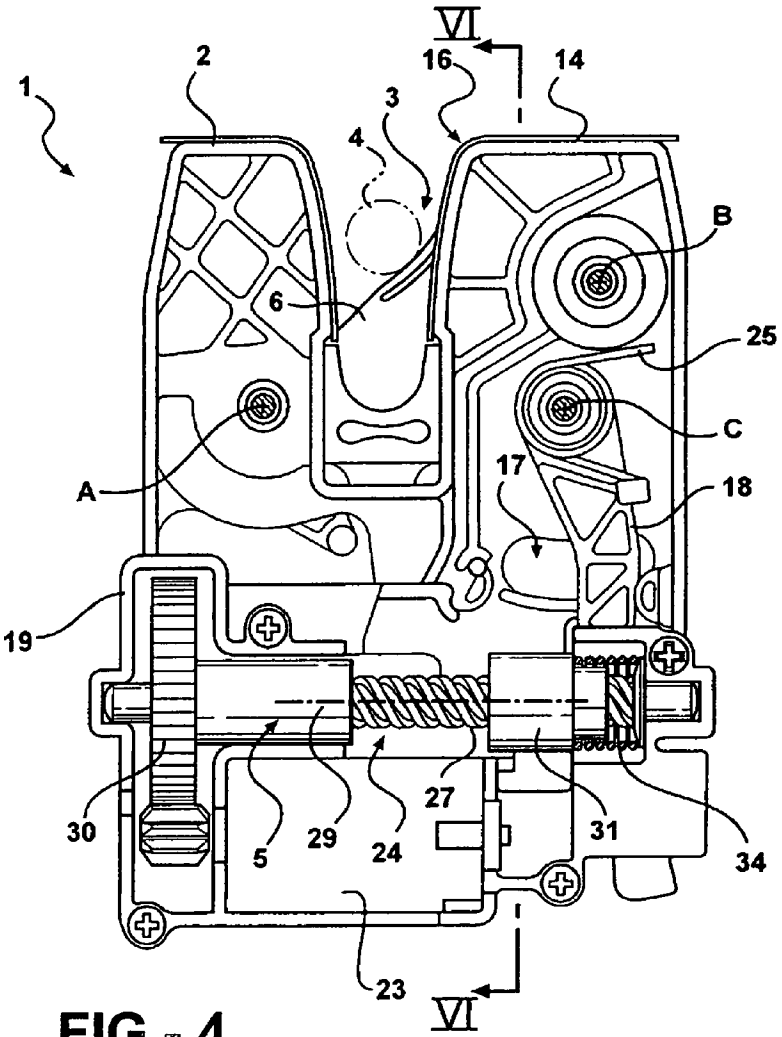
FIG. 4 is a bottom plan view of the lock in the release position.

Transmission assembly 24 comprises a gear train 30 activated by an output shaft of motor 23; an actuating member 31 for moving control lever 18, in a forward movement, between the rest position and the work position to release striker 4 from lock mechanism 3; and a screw 27 projecting from gear train 30 and connected to a nut screw 33 formed inside actuating member 31. More specifically, screw 27 and actuating member 31 extend inside shell 19 along an axis D parallel to the plane of plate 14, and end portion 28 is interposed, in use, between plate 14 and actuating member 31, and is offset with respect to axis D (FIGS. 3 and 4).

Figure 7:
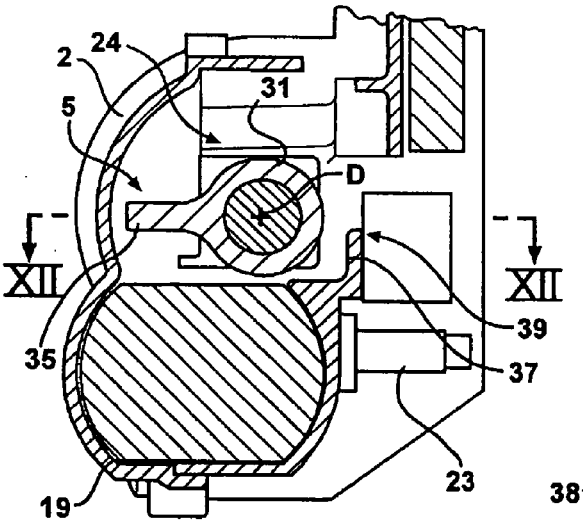
FIG. 7 is a cross-sectional view taken along line V-V in FIG. 3 of the lock in a different operating configuration.
Figure 8:
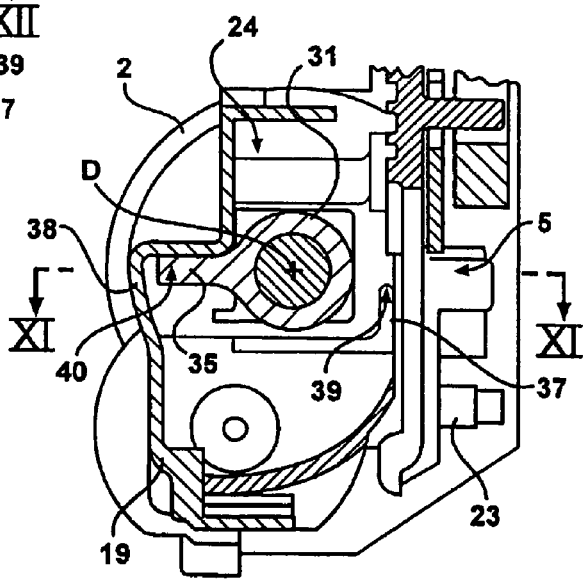
FIG. 8 is a cross-sectional view taken along line VI-VI in FIG. 4 of the lock in a different operating configuration.
Figure 9:
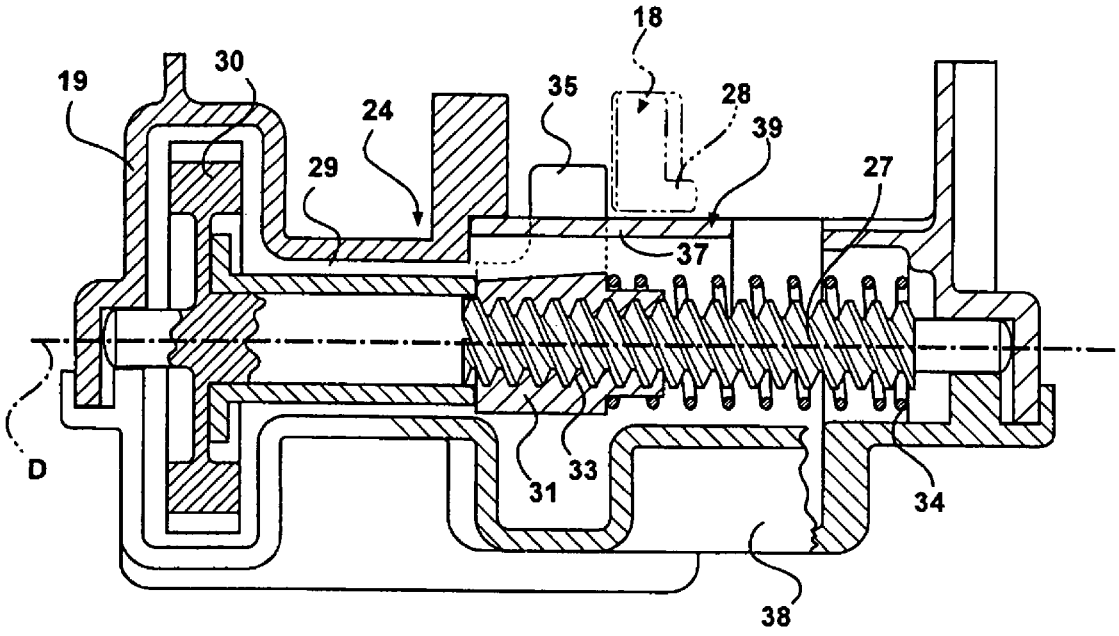
FIG. 9 is a cross-sectional view taken along line IX-IX in FIG. 5.
Figure 10:
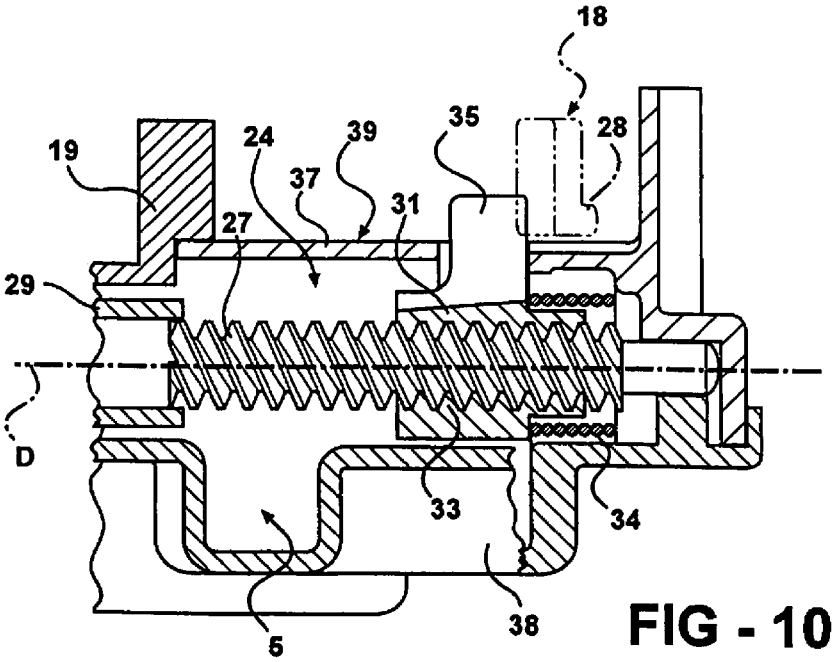
FIG. 10 is a cross-sectional view taken along line X-X in FIG. 6.
Figure 11:
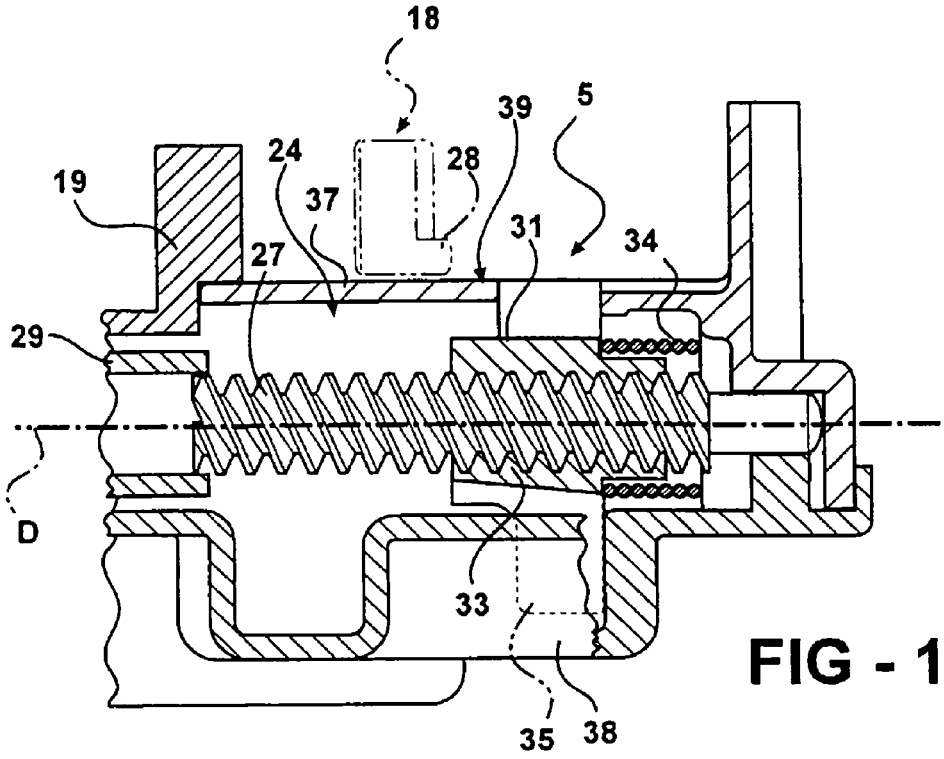
FIG. 11 is a cross-sectional view taken along line XI-XI in FIG. 8.
Figure 12:
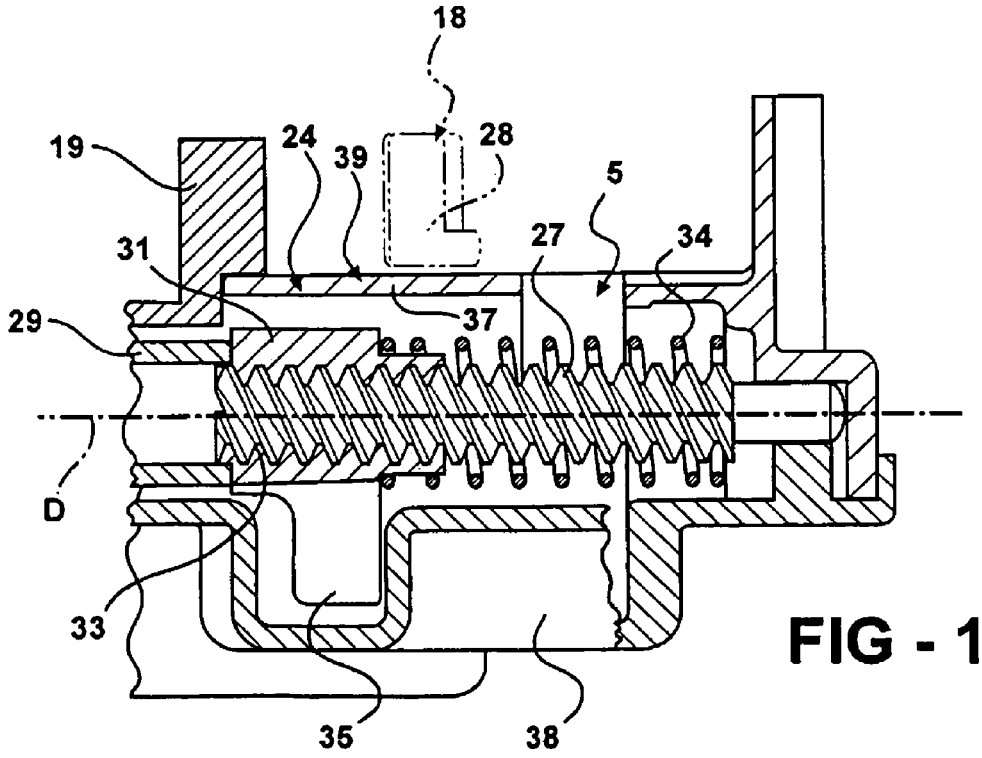
FIG. 12 is a cross-sectional view taken along line XII-XII in FIG. 7.

Actuating member 31 is movable by motor 23 along axis D, comprises a projection 35, radial with respect to axis D, for engaging end portion 28 to move control lever 18 from the rest position to the work position, and is connected elastically to shell 19 by a spring 34 fixed to actuating member 31 on the opposite side to screw 27. More specifically, actuating member 31 can be set to a first (FIGS. 3, 4, 5, 6) and second (FIGS. 7, 8) configuration. In the first configuration, actuating member 31 is movable by motor 23 in a first translational movement along axis D, and projection 35 faces plate 14 to engage end portion 28 and move control lever 18 from the rest position to the work position; and, in the second configuration, actuating member 31 is movable by spring 34 in a second translational movement along axis D, and projection 35 is positioned on the opposite side of axis D with respect to control lever 18, and is therefore detached from end portion 28.

Along an end portion of the first movement (FIG. 6), actuating member 31 is angularly free with respect to axis D and therefore movable from the first configuration to the second configuration. Similarly, along an end portion of the second movement (FIG. 7), actuating member 31 is angularly free with respect to axis D and therefore moveable from the second configuration to the first configuration.

The above movements are made possible by means of a first wall 37 and a second wall 38, which are carried by shell 19 and prevent rotation of actuating member 31 along respective initial portions of the first and second movement, respectively. More specifically, as shown in FIGS. 5-12, first wall 37 is fixed to shell 19, between plate 14 and axis D, extends parallel to axis D over the initial portion of the first movement of actuating member 31, and defines a first stop surface 39 for projection 35, to prevent the connection between nut screw 33 and screw 27 from rotating actuating member 31 about axis D.

Second wall 38 is fixed to shell 19 on the opposite side of axis D to plate 14, extends parallel to axis D over the initial portion of the second movement of actuating member 31, and defines a second stop surface 40 for projection 35, to prevent the connection between nut screw 33 and screw 27 from rotating actuating member 31 about axis D.

Therefore, while spring 25 restores control lever 18 to the rest position, actuating member 31 can be set to the second configuration and moved by spring 34 to perform the second movement. Since, during the return movement, projection 35 is located on the opposite side of axis D with respect to control lever 18, actuating member 31 and control lever 18 are disconnected to minimize the time taken by control lever 18 to perform the return movement. More specifically, the first movement and the second movement of actuating member 31 are defined by a stop member 29 and by the maximum-compression position of spring 34. More specifically, and as shown in FIGS. 9 to 12, stop member 29 projects from gear train 30 and surrounds part of the length of screw 27.

In actual use, when commanded by the user, lock 1 can be moved from a lock position (FIGS. 1 and 3), in which striker 4 is locked in known manner inside lock mechanism 3, to a release position (FIGS. 2 and 4), in which striker 4 is released from lock mechanism 3. In the lock position of lock 1, control lever 18 is in the rest position, and actuating member 31 is in the first configuration. More specifically, actuating member 31 rests against stop member 29, and projection 35 rests on first surface 39 of first wall 37, in a position between stop member 29 and end portion 28 of control lever 18.

When motor 23 is activated by the user, gear train 30 rotates screw 27, which, being connected to nut screw 33, transmits to actuating member 31 a force which tends to rotate and translate actuating member 31 with respect to axis D. Since first wall 37 prevents actuating member 31 from rotating about axis D, motor 23 causes actuating member 31 to translate along axis D and along the first portion of the first movement. During the first movement, actuating member 31 can be set to the first configuration, and, by means of projection 35, moves end portion 28 of control lever 18 from the rest position to the work position, thus compressing spring 34.

As a result, control lever 18 rotates about axis C, spring 25 is compressed, and actuating projection 21 pushes against interacting portion 15 of pawl 7. As a result, pawl 7 is pushed away from fork 6, thus enabling fork 6 to rotate about axis A from the lock position to the release position, thus releasing striker 4 from lock mechanism 3. By the time end portion 28 is moved completely by actuating member 31 from the rest position to the work position of control lever 18, actuating member 31 is located along the end portion of the first movement, and projection 35 no longer rests on first surface 39 of first wall 37.

By virtue of the connection between screw 27 and nut screw 33, actuating member 31 therefore rotates about axis D until projection 35 comes to rest against second surface 40 of second wall 38, thus switching from the first configuration to the second configuration. At this point, motor 23 is deactivated, and extension of spring 34 causes actuating member 31 to perform the second movement about axis D.

Spring 34 exerts on actuating member 31 a force, along axis D, which tends to translate actuating member 31 along axis D, while at the same time rotating actuating member 31 about axis D by virtue of the connection between screw 27 and nut screw 33. Along the initial portion of the second movement, actuating member 31 translates along axis D and remains angularly fixed about axis D, by virtue of second wall 38 preventing rotation of actuating member 31 about axis D. Along the end portion of the second movement, projection 35 no longer rests against second surface 40 of second wall 38, so that actuating member 31 is free to rotate about axis D from the second configuration to the first configuration.

Simultaneously with the second movement of actuating member 31, spring 25 restores control lever 18 from the work position to the rest position, so that actuating projection 21 is detached from and no longer exerts thrust on interacting portion 15 of pawl 7, and pawl 7, under the control of spring 12, comes to rest against the peripheral edge of fork 6 in the release position (FIGS. 2 and 4).

Springs 25 and 34 are so proportioned that the second movement of actuating member 31 and subsequent rotation of actuating member 31 take longer than the return movement of control lever 18. Consequently, when actuating member 31 is in the first configuration, just after completing the second movement, and lock 1 is in the release position, control lever 18 is in the rest position.

Lock 1 is restored to the lock position by slamming the door against the door post, so that striker 4 is inserted inside seat 8 and fork 6 clicks onto pawl 7. The advantages of lock 1 according to the present invention will be clear from the foregoing description. In particular, the time taken by control lever 18 to complete the return movement is minimized by the return movement of control lever 18 being in no way impeded. The fact that control lever 18 and lock mechanism 3 interact by means of actuating projection 21 and interacting portion 15 also minimizes the time taken by fork 6 to move into the release position, in which seat 8 is positioned facing the insertion direction of striker 4. Consequently, the time taken for lock 1 to be restored to the lock position, after being released by release mechanism 5, is also minimized.

Clearly, changes may be made to lock 1 as described and illustrated herein without, however, departing from the scope of the invention as defined in the accompanying claims.

What is claimed is:

1. An automotive door lock for releasably engaging a striker (4), said door lock comprising:

a supporting body (2);

a fork (6) pivotally coupled to said supporting body (2) for pivotal movement between a lock position engaging the striker (4) and a release position allowing withdrawal of the striker (4);

a pawl (7) pivotally coupled to said supporting body (2) for engaging said fork (6) to releasably retain said fork (6) in said lock position;

a control lever (18) pivotally coupled to said supporting body (2) for interacting with said pawl (7), said control lever (18) is loaded elastically into a rest position and can be set to a work position engaging said pawl (7) and pivoting said pawl (7) to disengage from said fork (6) thereby allowing said fork (6) to pivot to said release position; and an actuating member (31) movable along an axis (D) and including a projection (35) interacting with said control lever (18), said projection (35) extending radially with respect to said axis (D), wherein said actuating member (31) is set to a first configuration and selectively activated to perform a first translational movement along said axis (D) to move said control lever (18) in a forward movement from said rest position to said work position, and wherein said actuating member (31) is set to a second configuration disconnected with said control lever (18) and guided by an elastic member (34) to perform a second translational movement along said axis (D), opposite to said first translational movement, during a return movement of said control lever (18) to said rest position to minimize the time taken to complete said return movement.

2. A lock as set forth in claim 1 further including a screw (27) operatively coupled to said actuating member (31) for translating said actuating member (31) along said axis (D).

3. A lock as set forth in claim 2 further including first guide means (37, 39) disposed on one side of said axis (D) and extending parallel to said axis (D) along a first portion of said first translational movement of said actuating member (31) for engaging said projection (35) to prevent said actuating member (31) from rotating about said screw (27) thereby maintaining said actuating member (31) in said first configuration.

4. A lock as set forth in claim 3 wherein said actuating member (31) is rotatable about said screw (27) along a second portion of said first translational movement of said actuating member (31) thereby allowing said actuating member (31) to move into said second configuration.

5. A lock as set forth in claim 4 further including second guide means (38, 40) disposed on a side of said axis (D) opposite said first guide means (37, 39) and extending parallel to said axis (D) along a first portion of said second translational movement of said actuating member (31) for engaging said projection (35) to prevent said actuating member (31) from rotating about said screw (27) thereby maintaining said actuating member (31) in said second configuration.

6. A lock as set forth in claim 5 wherein said actuating member (31) is rotatable about said screw (27) along a second portion of said second translational movement of said actuating member (31) thereby allowing said actuating member (31) to move into said first configuration.

7. A lock as set forth in claim 6 further including a drive mechanism (23, 30) for operating said screw (27).

* * * * *